US005469663A

United States Patent [19]

TenBrink et al.

[11] Patent Number: 5,469,663

[45] Date of Patent: Nov. 28, 1995

[54] SNAP-IN ATTACHMENT OF WINDOW PANE LIFT PLATE TO WINDOW REGULATOR

[75] Inventors: Jay T. TenBrink, Goodrich; Maryanne R. Farkas, Bloomfield Hills, both of Mich.

[73] Assignee: Chrysler Corporation, Highland Park, Mich.

[21] Appl. No.: 334,095

[22] Filed: Nov. 4, 1994

[51] Int. Cl.[6] ..... E05F 11/38

[52] U.S. Cl. ..... 49/375; 49/349; 49/352

[58] Field of Search ..... 49/375, 374, 352, 49/349, 351, 352, 348

[56] References Cited

U.S. PATENT DOCUMENTS

| | | | |
|---|---|---|---|
| 4,026,088 | 5/1977 | Akabane | 52/628 |
| 4,706,412 | 11/1987 | Kobrehel | 49/352 |
| 4,829,630 | 5/1989 | Church et al. | 49/374 X |
| 4,910,917 | 3/1990 | Brauer | 49/348 |
| 4,991,351 | 2/1991 | Bertolini | 49/375 X |
| 5,038,519 | 8/1991 | Huebner | 49/375 |

*Primary Examiner*—Philip C. Kannan
*Attorney, Agent, or Firm*—Margaret A. Dobrowitsky

[57] ABSTRACT

A glider block assembly for a window regulator in a motor vehicle structure includes a glider block and a spring clip adapted to receive a pin with an engaging head extending from a window lift plate. The glider block has an opening sized to receive the pin and a guide pin slot intersecting the opening. The spring clip is disposed in the spring clip slot and provides an entry gap smaller than the engaging head. The clip extends in part across the opening to provide an entry gap smaller than the engaging head. The spring clip expands to allow the engaging head to pass therethrough in response to pressure of the head thereagainst when the pin is received by the block and snaps back behind the head, thereby retaining the plate to the block.

12 Claims, 1 Drawing Sheet

SNAP-IN ATTACHMENT OF WINDOW PANE LIFT PLATE TO WINDOW REGULATOR

TECHNICAL FIELD

This invention is directed to motor vehicle window regulators and window mounting devices, and more specifically to an interface between the regulator and the window mounting devices.

BACKGROUND OF THE INVENTION

Window regulators are used to move glass window panes in motor vehicles between open and closed positions. The window pane moves within guide channels provided by the motor vehicle door structure. The window regulator moves the window pane up and down between an upward closed position and a downward open position with the guide channels in the door guiding the glass in its movement between the open and closed positions.

The window pane is commonly supported by a lift plate attached to the regulator by threaded fasteners. Assembly of the lift plate to the regulator is accomplished by providing the lift plate with a threaded stud which is passed through an aperture in the regulator, and subsequently threading a nut over the end of the stud. Because this assembly operation must often be executed in a hard to reach part of the door offering limited or no visibility, it requires a great deal of dexterity and care to install the nuts without dropping them. Dropped nuts remaining in the door may rattle in the completed vehicle.

A difficulty with installing the window regulator into a door is that the upward and downward path of the window pane must be parallel to the guide channels so that the window pane does not get stuck. One way to achieve this is to align guide tracks of the regulator parallel to the guide channels. Producing such alignment can be difficult, as it may require aligning the regulator with respect to the guide channels so that the window is provided with the necessary orientation to allow it to move freely in the guide channel when moved by the regulator.

It is desired to provide an attachment between the lift plate for the window pane and the window regulator requiring no loose parts such as nuts. It is also desired to provide such an attachment rendering the operation of the window relatively insensitive to the mounted position of the window regulator relative to the position of the guide channels.

SUMMARY OF THE INVENTION

A glider block assembly for a window regulator in a motor vehicle structure, adapted to receive a window lift plate having a pin with an engaging head spaced from a plate surface, is disclosed comprising a glider block and a spring clip. The glider block has an opening sized to receive the pin and a guide pin slot intersecting the opening. The spring clip is disposed in the spring clip slot and defines an entry gap smaller than the engaging head. The clip extends in part across the opening to provide an entry gap smaller than the engaging head. The spring clip expands to allow the engaging head to pass therethrough in response to pressure of the head thereagainst when the pin is received by the block. With the head moving past the clip, the clip snaps back behind the head, thereby retaining the plate to the block.

A snap-in attachment between a glider block and a lift plate for a window regulator in a motor vehicle structure with the lift plate adapted to receive a window pane is disclosed comprising the lift plate, the glider block and a spring clip. The lift plate has a pin with an engaging head spaced from a plate surface. The glider block defines an opening sized to receive the pin and defines a clip slot intersecting the opening. The spring clip is disposed in the clip slot and extends in part across the opening defines an entry gap smaller than the engaging head. The spring clip expands to allow the engaging head to pass therethrough in response to pressure of the head thereagainst and snaps back behind the head, thereby retaining the plate to the block.

A window system is disclosed for use in a motor vehicle structure providing first and second window guide channels enables an operator to move a window pane from a downward open position to an upward closed position and comprises a window regulator, a lift plate and a glider block. The window regulator is functionally disposed between the vehicle structure and the window pane and is responsive to operator input to raise and lower the window pane. The lift plate has a pin with an engaging head spaced from a plate surface and is fixed to a lower portion of the window pane. The glider block assembly is part of the regulator and defines an opening sized to receive the lift plate pin and has a spring clip intersecting the opening and defining an entry gap smaller than the engaging head. The spring clip expands to allow the engaging head to pass therethrough in response to pressure of the head thereagainst and snaps back behind the head, thereby retaining the plate to the block.

The snap-in attachment of the present invention employs a spring clip and engaging pin combination which eliminates the need for any loose fasteners such as bolts and nuts, thereby eliminating the possibility of loose fasteners falling into the structure and facilitating installation of the window. The present invention also provides a substantially horizontal slot that is part of the snap-in attachment providing relative float in the fore-aft direction between the window pane and the window regulator, allowing the guide channels to position the window pane in the fore-aft direction.

DETAILED DESCRIPTION OF THE PREFERRED EMBODIMENT

Figure 1:
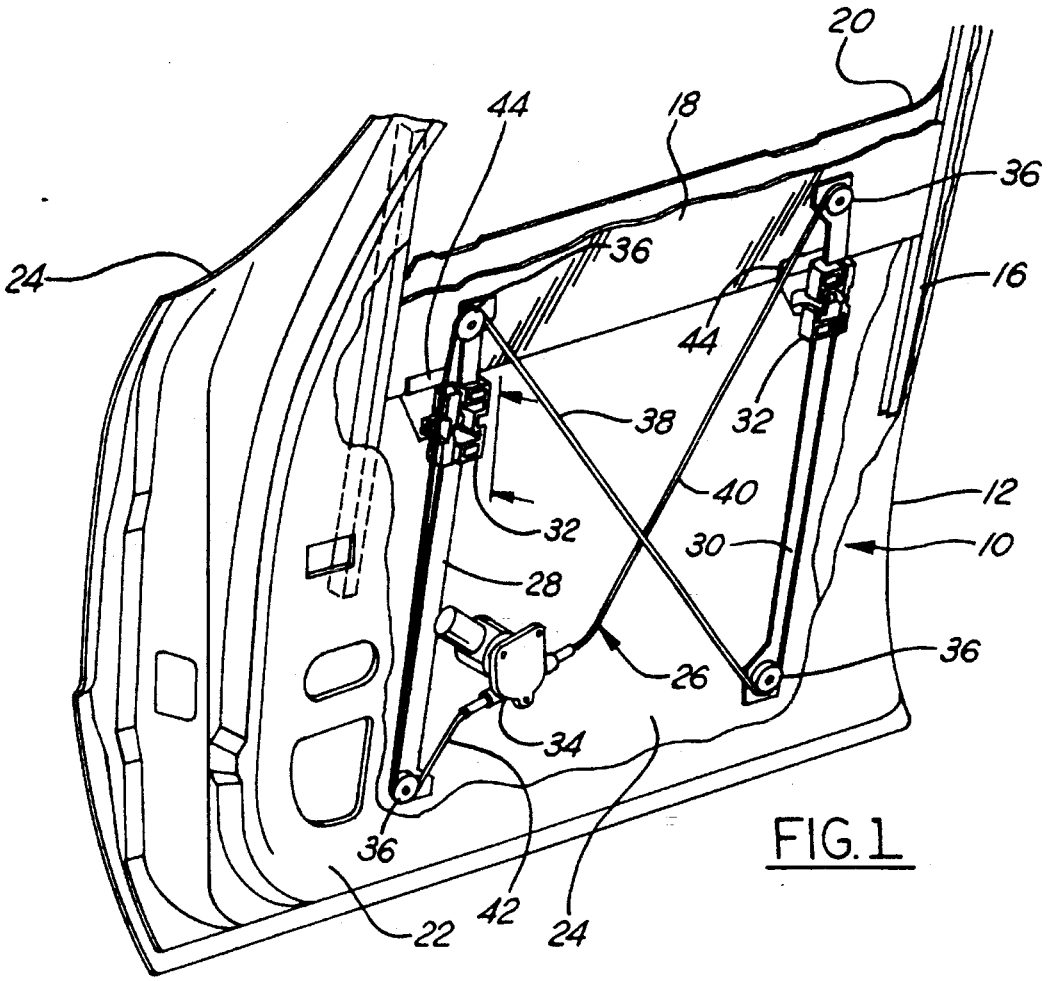
FIG. 1 is a perspective view of an inner side of a vehicle door with a substantial portion of an inner panel broken out to expose a window regulator mechanism.

A window system 10 shown in FIG. 1 is mounted in a vehicle door 12. The door 12 has a fore guide channel 14 and an aft guide channel 16. The fore and aft guide channels 14 and 16 are substantially C-shaped, are open toward each other, and are spaced to receive a window pane 18 for slidable disposition therein. The channels 14 and 16 extend to the window opening 20 in the door 12.

The door 12 has an inner panel 22 and an outer panel 24. A dual lift cable and drum type regulator 26, as illustrated in FIG. 1, is mounted to the inner panel 22.

The regulator includes fore and aft tracks 28 and 30. A glider block 32 is slidably disposed on each of the tracks 28, 30. A motor and drum assembly 34 is mounted to the inner panel 22. Pulleys 36 are disposed at top and bottom ends of the racks 28 and 30. A first cable 38 extends vertically upward from the glider block 32 on the fore track 28, wrapping around the upper pulley and traversing the door diagonally downward to the lower pulley of the aft track. The first cable then extends vertically upward to the glider block 32 on the aft track 30. A second cable 40 extends vertically upward from the glider block 32 on the aft track 30, around the pulley 36 at the top of the aft track 30, and diagonally downward to the motor and drum assembly 34. A third cable 42 extends from the motor and drum assembly 34 diagonally downward to the pulley 36 at the bottom of the fore track 28 and extends vertically upward to the glider block 32 on the fore track 28. It should be appreciated that a hand crank mechanism can be substituted for the motor in the motor and drum assembly 34.

The regulator 26 is characterized as a dual lift regulator because it supports the window pane 18 at both fore and aft locations with the lift plates 44 attached to the glider blocks 32.

The lift plates 44 have a C-shaped opening 46 receiving the window pane 18. An insulator 48 is disposed between the lift plate and the window pane 18. The lift plate 44 defines a lift plate surface 50 disposed beneath the window pane 18. A pin 52 is pressed into the lift plate 44 and projects out from the lift plate surface 50. An engaging head 54 of the pin 52 is defined by a neck 56 in the pin, with the engaging head 54 being spaced from the plate surface 50.

The glider block 32 is molded of plastic. The block 32 defines an elongated opening or slot 58 with a first width approximately equal to but slightly larger than the engaging head 54 of the pin 52, and a substantially larger second width. The slot, or opening, 58 is maintained in a generally horizontal position. The block 32 has a tapered lead 60 surrounding the opening 58 to facilitate entry of the pin 52. The tapered lead 60 is provided by a plurality of ribs 61 in the preferred embodiment. The ribs 61 are used to provide the tapered lead instead of a smooth forming so as to not to exceed a maximum section thickness permitted by plastic molding. A clip slot 62 intersecting the opening 58 is also defined by the guide block 32. The clip slot 62 is preferably configured to be substantially parallel to the lift plate surface 50. The block 32 also has a track slot 64 perpendicular to the elongated opening 58 accommodating its sliding disposition on either of the tracks 28, 30. The block 32 has pockets 66 for receiving cable ends. The glider block 32 has an engagement spring provided by a pair of horizontally extending, arcuately shaped leaf springs 68. The leaf springs 68 are configured to contact the lift plate surface 50 to eliminate tilting of the block 32 relative to the lift plate 44. One of the leaf springs 68 in the preferred embodiment is shown as being split into two parallel sections. Alternatively, the engagement spring can take forms other than the leaf springs 68. For example, a foam rubber pad (not shown) can be positioned between the block 32 and the lift plate 44 to provide the desired bias therebetween.

Figure 2:
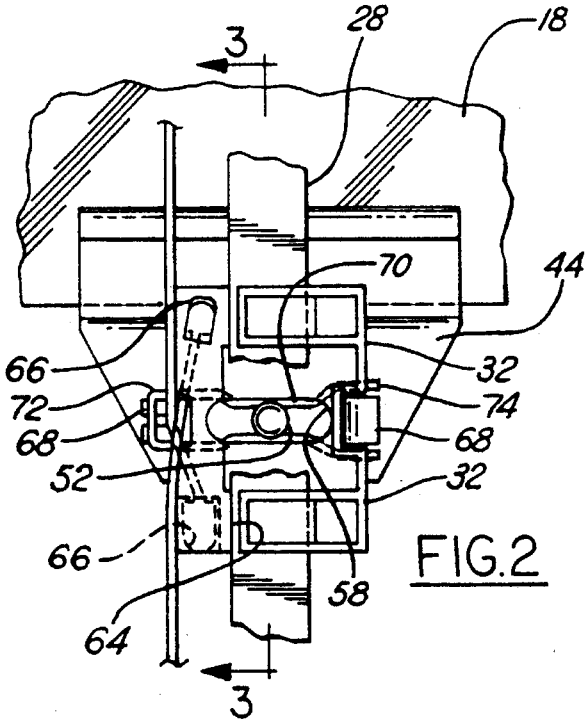
FIG. 2 shows a glider block and a lift plate viewed from the direction of arrows of FIG. 1.
Figure 3:
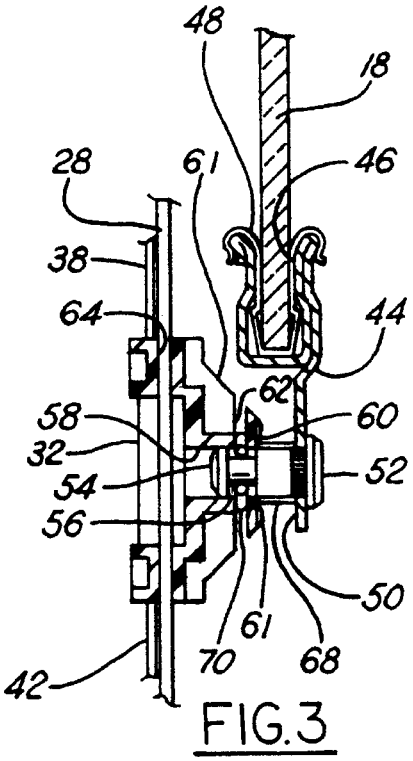
FIG. 3 is a partial sectional view of the glider block and lift plate of FIG. 2 in the direction of arrows 3.

A spring clip 70 is disposed in the clip slot 62. The clip is disposed in part across the opening 58 and in a first position, shown in FIGS. 2 and 3, and defines an entry gap smaller than the engaging head 54. The spring clip 70 is expanded at a closed end 72 and an open end 74 to retain the clip 70 in the clip slot 62. A combination of the glider block 32 and the spring clip 70 may be identified as a glider block assembly.

The present invention is advantageously employed in the following manner. Two lift plates 44 are bonded to a lower edge of the window pane 18 in predetermined locations for alignment with the tracks of the window regulator assembly 26. The window regulator assembly 26 is placed in the door. The aft track 30 is fixed to the inner panel 22 by two pre-mounted screws, one at each of the top and the bottom of the tracks. This motor and drum assembly 54 is also mounted to the inner panel 22. The assembled window pane 18 and lift plates 44 are inserted into the fore and aft guide channels 14, 16 of the door 12. The glass is positioned so that the pins 52 are aligned with the elongated openings 58 of the blocks 32. The pins 52 are then forced into the openings 58, being guided by the tapered lead 60, and engaging the spring clip 70. Forcing the engaging head 54 against the spring clip 70 causes the spring clip to expand, from the first position to a second position (not shown), allowing the engaging head 54 to pass therethrough with the spring clip 70 snapping back behind the head 54 and into the neck 56 of the pin 52. This provides a positive lock between the lift plate 44 and the guide block 32, thereby retaining the plate 44 to the block 32. The leaf springs 68 engage the lift plate surface 50, minimizing any tendency of the block 32 to rattle or otherwise move on the pin, as well as tending to minimize any twisting moments between the block 32 and the lift plate 44.

The window pane 18 is raised to the closed position by energizing the motor to displace the guide blocks 32, and hence, the window pane 18. The fore track 28 is biased upward to seat the window pane 18 in an upper portion of the guide track (not shown) and is then fixed in place relative to the inner panel 22 with the upper and lower mounting screws. Only this vertical positioning of the fore track 28 is necessary to position both the window pane 18 and the regulator 26, as the elongated openings 58 accommodate relative fore aft movement between the window pane 18 and the fore and aft tracks 28 and 30. The slots 58 also allow the pins 52 to rotate freely therein, further facilitating installation of the regulator 26 and subsequent up and down movement of the window 18 without the regulator binding or sticking.

The attachment of the glass window pane 18 to the regulator 26 is thereby accomplished very quickly with substantially no chance of fasteners being dropped into the door where they could potentially cause a rattle. Additionally, this snap-in attachment saves a significant amount of time, and therefore labor cost, in the installation and assembly of a window pane and regulator in a vehicle door. Servicing of the door 12 is also benefitted by this invention. The window pane 18 is easily removed from the door 12 by first sliding out the spring clips 70 in a direction parallel to the slot 58, and then lifting the window pane 18 out through the window opening 20.

Other aspects, objects and advantages of this invention can be obtained from a study of the drawings, the disclosure and the appended claims.

We claim:

1. A glider block assembly for a motor vehicle window regulator, comprising:

a glider block defining an opening sized to receive a pin of a window lift plate extending from a surface of the plate and also defining a clip slot intersecting the opening; and a spring clip disposed in the clip slot extending in part across the opening and defining in a first position an entry gap smaller than an engaging head of the pin and defining in a second position an expanded entry gap allowing the engaging head to pass therethrough in response to pressure of the head thereagainst when the pin is received by the block, snapping back behind the head, and thereby retaining the plate to the block.

2. A glider block assembly as disclosed in claim 1, wherein the opening in the block for receiving the pin is elongated in a first direction to define the opening as a slot and the spring clip is also elongated and provides a substantially constant entry gap across the opening in the first position.

3. A glider block assembly as disclosed in claim 1, additionally comprising an engagement spring for placement between the block and the surface of the lift plate.

4. A glider block assembly as disclosed in claim 3, wherein the engagement spring is integrally formed with the block, extending therefrom.

5. A snap-in attachment between a glider block and a lift plate for a window regulator in a motor vehicle structure with the lift plate adapted to receive a window pane comprising:

the lift plate having a pin with an engaging head spaced from a plate surface;

a glider block defining an opening sized to receive the pin and defining a clip slot intersecting the opening; and a spring clip in a first position providing an entry gap smaller than the engaging head and disposed in part across the opening wherein the spring clip expands to a second position to allow the engaging head to pass therethrough in response to pressure of the head thereagainst when the pin is received by the block, snapping back toward the first position from the second position behind the head, thereby retaining the plate to the block.

6. A snap-in attachment between a glider block and a lift plate as disclosed in claim 5, wherein the opening in the block for receiving the pin is elongated in a first direction to define a slot and the spring clip is also elongated and defines a substantially constant entry gap across the opening in the first position.

7. A snap-in attachment between a glider block and a lift plate as disclosed in claim 5, additionally comprising an engagement spring for placement between the block and the lift plate.

8. A snap-in attachment between a glider block and a lift plate as disclosed in claim 7, wherein the engagement spring is integrally formed with the block, extending therefrom.

9. A window system for use in a motor vehicle structure providing first and second window guide channels enabling an operator to move a window pane from a downward open position to an upward closed position, comprising:

a window regulator functionally disposed between the vehicle structure and a window pane and being responsive to operator input to raise and lower the window pane;

a lift plate having a pin with an engaging head spaced from a plate surface and fixed to a lower portion of the window pane; and a glider block assembly of the regulator connected to the lift plate by the pin and defining an opening sized to receive the pin and having a spring clip providing an entry gap smaller than the engaging head and disposed in part across the opening wherein the spring clip expands to allow the engaging head to pass therethrough in response to pressure of the head against the clip when the pin is received by the block and snaps back behind the head, thereby retaining the plate to the block.

10. A window system as disclosed in claim 9, wherein the opening in the block for receiving the pin is elongated in a first direction to define a slot and the spring clip is also elongated and provides a substantially constant entry gap across the opening in the first position.

11. A window system as disclosed in claim 9, additionally comprising an engagement spring for placement between the block and the lift plate.

12. A window system assembly as disclosed in claim 11, wherein the engagement spring is integrally formed with the block, extending therefrom.

* * * * *